US005463959A

United States Patent [19]

Kramer

[11] Patent Number: 5,463,959

[45] Date of Patent: Nov. 7, 1995

[54] 6.5 CALIBRE CARTRIDGE FOR RIFLES AND CARTRIDGE CHAMBER THEREFOR

[76] Inventor: Thomas Kramer, Karl-Funke-Strasse 66, 4600 Dortmund 1, Germany

[21] Appl. No.: 239,618

[22] Filed: May 9, 1994

Related U.S. Application Data

[63] Continuation of Ser. No. 952,704, Nov. 13, 1992, abandoned.

[30] Foreign Application Priority Data

Mar. 15, 1991 [DE] Germany ..... 41 08 550.7

[51] Int. Cl.[6] ..... F42B 5/26

[52] U.S. Cl. ..... 102/464; 42/76.01; 89/14.05

[58] Field of Search ..... 102/430, 464, 102/469; 42/76.01; 89/14.05

[56] References Cited

U.S. PATENT DOCUMENTS

| | | | |
|---|---|---|---|
| 1,753,413 | 4/1930 | Hatcher | 102/464 |
| 2,269,316 | 1/1942 | O'Neil | 102/430 |
| 2,455,080 | 11/1948 | Miller et al. | 102/464 |
| 2,831,287 | 4/1958 | Maillard | 102/430 |
| 3,998,161 | 12/1976 | Booth | 102/464 |

FOREIGN PATENT DOCUMENTS

| | | |
|---|---|---|
| 865284 | 7/1978 | Belgium . |
| 689793 | 4/1940 | Germany . |
| 702356 | 2/1941 | Germany . |

OTHER PUBLICATIONS

Barnes, *Cartridges of the World,* 1965, pp. 182–184, 205, 242–245, 264 and 265.

*Lyman Reloading Handbook for Rifle, Pistol and Muzzle Loading,* 45 Ed, 1970, pp. 61–69.

*Primary Examiner*—Harold J. Tudor

*Attorney, Agent, or Firm*—Michael J. Striker

[57] ABSTRACT

With the aim of providing a 6.5 caliber cartridge for rifles having a casing which is suitable for both light and heavy projectiles without impairing accuracy and which results in an increase in the efficiency of the propellant charge, a reduction in the stress on the barrel and breech of the weapon, and the production of shorter and hence lighter weapons, as well as in an increase in the service life of the reloadable casing, a cartridge is proposed which has a reduced length of the virtually cylindrical region of the casing between the casing base and the transition into the casing neck as well as by an extremely flat transition into the casing neck has been developed along with a suitable cartridge chamber.

8 Claims, 2 Drawing Sheets

6.5 CALIBRE CARTRIDGE FOR RIFLES AND CARTRIDGE CHAMBER THEREFOR

This is a continuation of application Ser. No. 07/952,704 filed Nov. 13, 1992, now abandoned.

BACKGROUND OF THE INVENTION

The present invention is directed to a cartridge for 6.5 mm caliber rifles and a cartridge chamber suitable for this cartridge.

Cartridges according to the prior art as set forth for example in the firearms ordinance of the Federal German law governing firearms of Jan. 1, 1983 generally have the disadvantage that the entire range of possible projectiles, particularly both light and heavy projectiles, cannot be fired with one and the same cartridge casing without a loss in accuracy and air velocity. Large-volume cartridges filled with slow-burning powder are generally used to achieve high air velocities. The conventional casing shoulder which is comparatively steep with respect to the longitudinal axis of the casing causes burnt matter and unignited powder to enter the barrel and consequently leads to erosion of the barrel which impairs the accuracy of the weapon and the service life of the barrel. Since the shape of the casing has an impact on the shape of the cartridge chamber, the aforementioned disadvantages can also be traced back to the known cartridge chambers.

SUMMARY OF THE INVENTION

Proceeding from the prior art, the invention is primarily based on the need for a cartridge for "6.5 mm" caliber rifles whose casing is suitable for the entire range of projectiles of this caliber, and where the shape of the casing then contributes more extensively to the reduction of both its own wear and that of the weapon.

In keeping with these objects and with others which will become apparent hereinafter, one feature of the present invention resides, briefly stated, in a cartridge for "6.5 mm" caliber rifles including a casing which contains the propellant charge and passes into the casing neck via a transition region, and a projectile supported in the casing neck in which in accordance with the applicant's invention the following dimensions are selected:

| | |
|---|---|
| diameter of a casing base | 12.01 mm |
| diameter of a central region at a commencement of the transition region into a neck region | 11.72 mm |
| diameter of the neck region | 7.55 mm |
| diameter of the projectile | 6.70 mm |
| total length of the casing | 51.20 mm |
| length from the base to the transition region | 40.96 mm |
| length of the transition region | 2.49 mm |
| length of the neck region | 7.75 mm |
| projectile overlap | variable. |

The cartridge chamber for cartridges specified hereinabove includes a first region corresponding to the region of the cartridge casing between the base and transition into the casing neck, a second region corresponding to the transition of the cartridge casing into its neck, an adjoining third region corresponding to the casing neck, and an adjoining fourth region forming the transition into the barrel with a cylindrical initial region and an adjoining region which narrows in diameter to the field diameter of the barrel, wherein the cartridge chamber has the following dimensions:

| | |
|---|---|
| initial diameter of the first region | 12.05 mm |
| length of the first region | 40.93 mm |
| diameter of the first region at the commencement of the second region | 11.75 mm |
| length of the second region | 2.49 mm |
| diameter of the second region at the commencement of the third region | 7.56 mm |
| length of the third region | 7.98 mm |
| diameter of the initial region of the fourth region | 6.71 mm |
| length of the initial region | 10.00 mm |
| length of the adjoining region of the fourth region | 4.96 mm |
| final diameter of the adjoining region | 6.70 mm |

The virtually cylindrical construction of the area of the casing between the base and shoulder of the casing enables a shorter design of this area and accordingly of the corresponding area of the cartridge chamber. The shoulder of the casing which forms the transition to the neck of the casing and which, with a slope of 40°, is comparatively flat compared to the longitudinal axis of the casing provides in combination with the correspondingly designed cartridge chamber a decrease in the burnt matter entering the barrel on the one hand and an increase in the efficiency of the propellant charge on the other hand. The reduction in the length of the casing, to which the flatness of the shoulder area also contributes, makes it possible to produce shorter and accordingly lighter and more accurate weapons enabling accurate firing of both light and heavy projectiles associated with the casing, according to the invention, with the respective prescribed parameters. The virtually cylindrical construction of the casing area between the base and shoulder of the casing accordingly also contributes to a reduction in the stress on the breech when firing. The flat shoulder forming the transition to the casing neck further results in a longer service life of the reloadable casing.

The dimensions of the casing are so-called maximum values and those of the cartridge chamber are so-called minimum values corresponding to the wording of the firearms ordinance defining the agreement of the casing with the cartridge chamber or that of the cartridge chamber with the casing. Within the framework of the invention, given the intended goal, deviations from the dimensions prescribed according to the invention in the casing relative to a reduction and in the cartridge chamber relative to an increase with respect to machining tolerances are in the order of magnitude of several hundredths of a millimeter with respect to diameter and several tenths of a millimeter with respect to length. The 6.5 caliber is also not fixed in practice at 6.5 mm. All known variants of the projectile in terms of weight, shape and length can be used assuming that the overall length of the cartridge is defined by the length of the cartridge chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
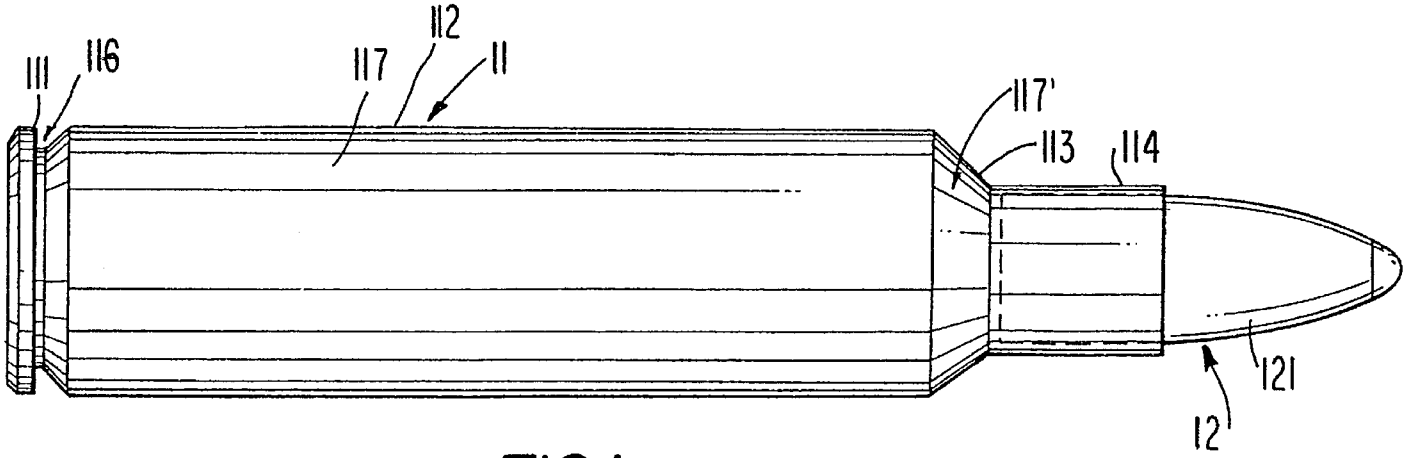
FIG. 1 is a side view of the cartridge having the casing according to the invention.

The cartridge shown in FIG. 1 includes the casing 11 and the projectile 12. The casing 11 has a virtually cylindrical region 112 proceeding from the base 111. This region 112 passes into the casing neck 114 via the shoulder 113. The extraction groove in the base 111 of the casing is designated by 116 and forms a stepped transition in the cylindrical region 112 with a bevelled portion merging into the latter. The casing which is constructed so as to be virtually cylindrical in the region between the base 111 and the shoulder 113 provides a comparatively large powder chamber 117 which is also supplemented by the region 117' defined by the shoulder 113. This enables a short construction of the casing. The very flat gradient of the shoulder 113 forming the transition into the sleeve neck 114 contributes to the short design. The length of the projectile 12 associated with the casing 11 is defined by the abutment of the projectile of the cartridge located in the cartridge chamber against the end side of the barrel. It can also be varied within limits in the maximum range by the insertion depth of the projectile 12 in the casing neck 114.

Figure 2:
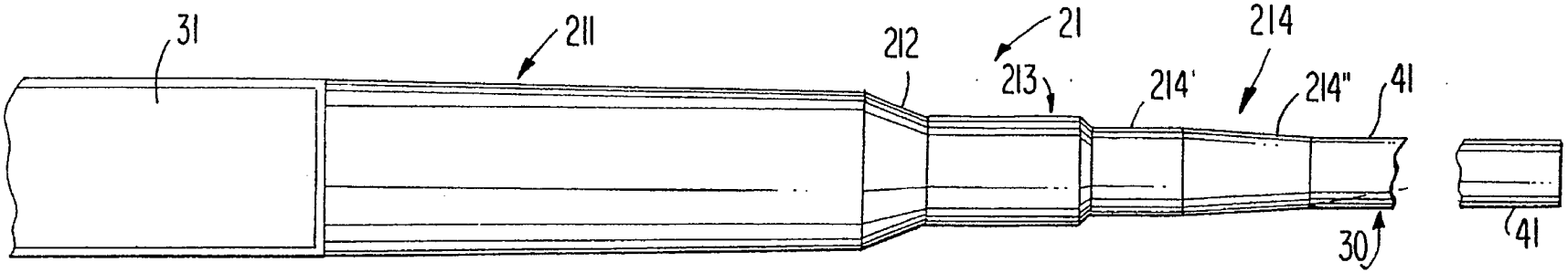
FIG. 2 is a view of an adapted cartridge chamber which is only schematic and not true to scale.
Figure 3:
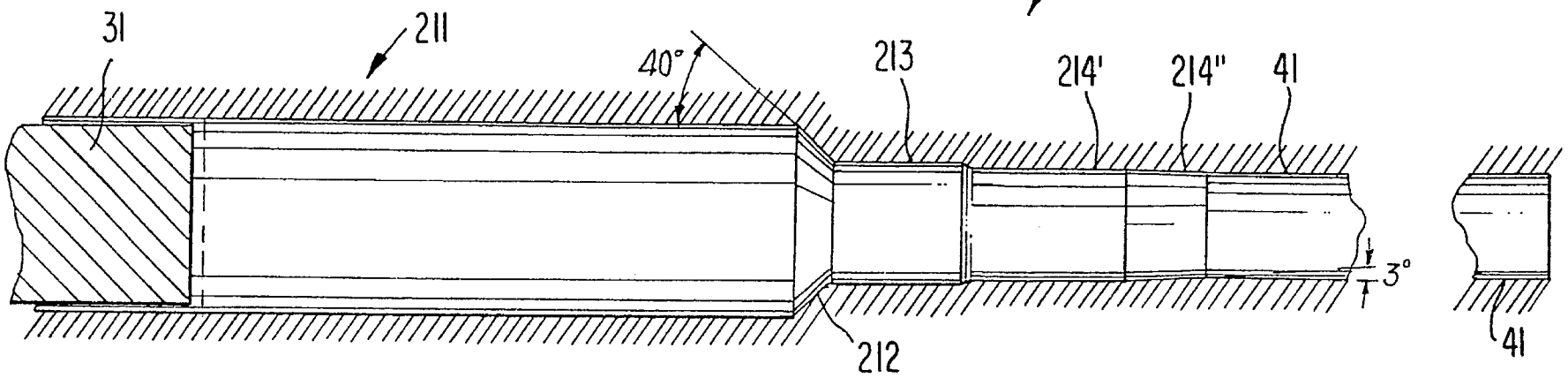
FIG. 3 is a view of an adapted modified cartridge chamber.

The region 211 of the cartridge chamber 21 facing the breech 31, shown schematically in FIG. 2, has the minimum dimensions allowing for the maximum dimensions of the cartridge 11, 12 according to FIG. 1 corresponding to the casing base 111 and the casing region 112. The slightly greater length of the casing region 111, 112 results in the desired overlapping of the cartridge 11, 12, specifically the casing 11, over the cartridge chamber 21 on the breech side. The region 212 of the cartridge chamber corresponds to the region 113 of the casing 11, i.e. the casing shoulder. The region 213 of the cartridge chamber 21, whose diameter is adapted to the casing neck 114, adjoins this region 212. Adjoining the latter is the region 214 of the cartridge chamber into which the overlap 121 of the projectile 12 over the cartridge casing 11 extends. This region is formed by a first cylindrical partial region 214' and an adjoining second partial region 214" which passes into the barrel while narrowing in diameter. The barrel itself is designated by 41. The transition from the region 213 into the region 214' of the cartridge chamber can be conical as shown in the drawing, but it can also be constructed as a step, as illustrated in FIG. 3.

The comparatively flat shoulders 113 and 212 of the cartridge casing 11 and cartridge chamber 21, respectively, prevent burnt matter from entering the barrel 41 on the one hand and contribute to an increase in the efficiency of the propellant charge on the other hand. The slight amount of taper of the casing region 112 and the corresponding region of the cartridge chamber, respectively, brings about a maximum fixing of the casing 11 in its initial position at the moment of igniting the propellant charge, resulting in less stress on the breech 31. The slight amount of taper of the casing region 112 and flat casing shoulder 113 further results in a limited sealing of the casing. The casing can therefore be reloaded more often.

The dimension 6.45 (F) is the dimension corresponding to the lads of the gun barrel, while the dimension 6.70(Z) is the dimension corresponding to the grooves of the rifled barrel.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A cartridge for "6.5 mm" caliber rifles, comprising a casing having a base, a central region extending from said base and adapted to contain a propellant charge, a neck region, and a transition region located between said central region and said neck region; and a projectile supported in said neck region, said casing having the following dimensions:

| | |
|---|---|
| diameter of said casing base | 12.01 mm |
| diameter of said central region at a commencement of said transition region into said neck region | 11.72 mm |
| diameter of said neck region | 7.55 mm |
| diameter of said projectile | 6.70 mm |
| total length of said casing | 51.20 mm |
| length from said base to said transition region | 40.96 mm |
| length of said transition region | 2.49 mm |
| length of said neck region | 7.75 mm |
| projectile overlap | variable. |

2. A cartridge as defined in claim 1, wherein said central region has a transition region to said casing base, a diameter of said central region at a commencement of said transition region to said casing base being 11.97 mm at a distance of 3.80 mm from said base.

3. A cartridge as defined in claim 1, wherein said casing has an extraction groove in the region of said base.

4. A cartridge as defined in claim 1, wherein said casing has a transition from said base to said central region, said transition being formed as a stepped transition.

5. A cartridge as defined in claim 4, wherein said transition from said base to said central region includes a beveled transition portion.

6. A cartridge chamber for a cartridge having a casing with a base and central substantially cylindrical region extending from said base and adapted to contain a propellant charge, a neck region, and a transition region between said substantially cylindrical region and said neck region, said cartridge chamber including a first region corresponding to said substantially cylindrical region and a second region corresponding to said transition region, an adjoining third region corresponding to said neck region of said cartridge and an adjoining fourth region forming a transition into a barrel with a cylindrical initial region and an adjoining region which narrows in diameter to a field diameter of the barrel, said cartridge chamber having the following dimensions:

| | |
|---|---|
| initial diameter of said first region | 12.05 mm |
| length of said first region | 40.93 mm |
| diameter of said first region at the commencement of said second region | 11.75 mm |
| length of said second region | 2.49 mm |
| diameter of said second region at the commencement of said third region | 7.56 mm |
| length of said third region | 7.98 mm |
| diameter of said initial region of said fourth region | 6.71 mm |
| length of said initial region | 10.00 mm |
| length of said adjoining region of the fourth region | 4.96 mm |

-continued

| | |
|---|---|
| final diameter of said adjoining region | 6.70 mm |

7. A cartridge chamber as defined in claim 6, wherein said transition region between said third and fourth regions is formed as a step.

8. A cartridge chamber as defined in claim 6; and further comprising a conical transition from said third region to said fourth region.

* * * * *